US005759382A

United States Patent [19]

Utigard et al.

[11] Patent Number: 5,759,382

[45] Date of Patent: Jun. 2, 1998

[54] INJECTION OF POWDERED MATERIAL INTO ELECTROLYSIS CELLS

[75] Inventors: Torstein Utigard, Mississauga; Alejandro Bustos, Champigny-sur-Marne; Torbjorn Dahl, Dollard-des-Ormeaux, all of Canada

[73] Assignee: Canadian Liquid Air Ltd/Air Liquide Canada LTEE, Canada

[21] Appl. No.: 718,219

[22] Filed: Sep. 20, 1996

[30] Foreign Application Priority Data

Sep. 21, 1995 [CA] Canada ..... 2158794

[51] Int. Cl.[6] ..... C25C 3/14

[52] U.S. Cl. ..... 205/389; 205/392; 204/245; 204/246

[58] Field of Search ..... 204/245–246; 205/392, 336, 389

[56] References Cited

U.S. PATENT DOCUMENTS

| | | | |
|---|---|---|---|
| 2,900,319 | 8/1959 | Ferrand | 204/246 X |
| 3,135,672 | 6/1964 | Hirakawa et al. | 205/392 |
| 3,551,308 | 12/1970 | Capitaine et al. | 204/246 X |
| 4,126,525 | 11/1978 | Wakaizumi et al. . | |
| 4,392,926 | 7/1983 | Ohta et al. | 204/246 X |
| 4,417,958 | 11/1983 | Arnason et al. | 205/336 |
| 4,425,201 | 1/1984 | Wilson et al. . | |
| 4,469,570 | 9/1984 | Hays et al. | 204/245 X |
| 4,654,130 | 3/1987 | Tabereaux et al. . | |
| 5,318,759 | 6/1994 | Campbell et al. . | |
| 5,320,650 | 6/1994 | Simmons . | |
| 5,320,651 | 6/1994 | Drummond . | |
| 5,320,754 | 6/1994 | Kohn et al. . | |
| 5,320,818 | 6/1994 | Garg et al. . | |
| 5,322,549 | 6/1994 | Hayes . | |
| 5,322,916 | 6/1994 | O'Brien et al. . | |
| 5,322,917 | 6/1994 | Auman et al. . | |
| 5,324,430 | 6/1994 | Chung et al. . | |
| 5,328,503 | 7/1994 | Kumar et al. . | |
| 5,330,561 | 7/1994 | Kumar et al. . | |
| 5,332,597 | 7/1994 | Carolan et al. . | |

FOREIGN PATENT DOCUMENTS

| | | |
|---|---|---|
| 87 103606 | 11/1988 | China . |
| 440794 | 1/1982 | European Pat. Off. . |
| 69057 | 1/1983 | European Pat. Off. . |
| 206555 | 12/1986 | European Pat. Off. . |
| 0603798 | 6/1994 | European Pat. Off. . |
| 2483965 | 12/1981 | France . |
| 2914238 | 9/1980 | Germany . |
| 57041393 | 3/1982 | Japan . |
| 645676 | 10/1986 | Switzerland . |

*Primary Examiner*—Donald R. Valentine
*Attorney, Agent, or Firm*—Burns, Doane, Swecker & Mathis, L.L.P.

[57] ABSTRACT

In an electrolysis cell wherein powdered material are added to a bath of molten electrolyte, the anode is provided with a duct through which the powdered material may be fed to the electrolyte. Simultaneously, a gas which is preferably inert, is also fed together with the powdered material through the duct, and both are injected beneath the surface of the electrolyte.

25 Claims, 2 Drawing Sheets

INJECTION OF POWDERED MATERIAL INTO ELECTROLYSIS CELLS

BACKGROUND OF THE INVENTION (a) Field of the Invention

This invention relates to a method and an apparatus for adding powdered material to an electrolytic bath of molten material. More particularly, the present invention relates to the feeding of powdered material, such as alumina powder, by gas powder injection into aluminum electrolysis cells which for example contain molten cryolite.

(b) Description of Prior Art

It is known that aluminum smelting is an electrolytic process. Thus, an anode and a cathode are immersed in an electrolyte and a voltage is applied. In the aluminum smelting process, the cathode is the liquid aluminum pool contained in a carbon reservoir. The anode is a carbon block which is partially immersed in the electrolyte. Alumina (aluminum oxide or $Al_2O_3$) is supplied via alumina injectors which force the alumina into the cryolite bath. The electrolyte is non-miscible with aluminum and floats on top of the aluminum layer. Aluminum oxide dissolved in the cryolite undergoes electrolysis to produce liquid aluminum at the cathode and oxygen ions at the anode. The oxygen combines with carbon from the anode to form $CO_2$ gas. The anode and aluminum oxide are consumed as the electrolysis proceeds.

Two different types of anodes are used to replenish the carbon which is consumed during electrolysis. Prebaked anodes are carbon blocks which are pressed and baked in a furnace which is external to the electrolytic cell. The main advantage of this type of anode is that the volatiles produced during baking are contained and not vented to the atmosphere during the electrolysis process. The use of this type of anode also allows greater access to the surface of the electrolyte for feeding of alumina.

The other type of anode is called Soderberg. This type of anode is formed and baked in situ in the electrolytic cell. The anode is formed from a combination of pitch and carbon. As the anode is consumed, it is lowered in order to maintain a fairly constant distance between the surface of the anode and the liquid aluminum pool. More carbon and pitch is added to the anode. The part of the anode nearest the electrolyte is heated by the 970° C. temperature of the electrolyte. During this baking process, the pitch evolves gases which enter the environment. In addition, the large size of the Soderberg anode restricts access to the electrolyte. Alumina feeding to the electrolyte is performed by additions to the side and end channels. Many plants in the world still operate Soderberg type anodes.

During the electrolytic process, $Al_2O_3$ is consumed. Periodically, alumina is added to the electrolyte. Roughly, 1 kg of alumina is added per 100 kA of current per minute. Thus, depending on the current efficiency, a 180 kA cell consumes 1.8 to 2.0 kg of alumina per minute. Some center break prebaked anode cells feed every 20 minutes. Thus, 36 kg of alumina is added at one time to the cell. Adding this amount of alumina at room temperature to the electrolyte at 970° C. represents a large thermal drain on the system. This leads to freezing of the electrolyte on the cold alumina. If this occurs, the frozen electrolyte must first melt before dissolution of the alumina can occur. Also, an undissolved mixture of alumina and electrolyte is more dense than the electrolyte which can cause it to sink in the electrolyte. Depending on the density, mixtures that sink in the electrolyte can end up beneath the aluminum layer. Deposits beneath the aluminum layer can change the current profile in the cell leading to high local current densities and magnetic disturbances in the aluminum pool. This causes the cell current efficiency and process control to decrease. One solution to adding large quantities of alumina to the cell batchwise is to add alumina to the cell in small batches or even continuously.

All sorts of arrangements for adding alumina to a bath of molten cryolite have been disclosed, for example CN 87 103606 published on Nov. 30, 1988 (Guiyang Aluminum and Magnesium Design Institute); U.S. Pat. No. 4,654,130 issued Mar. 31, 1987 (Reynolds Metals Co.); U.S. Pat. No. 4,425,201 issued Jan. 10, 1984 (Reynolds Metals Co.); JP 57 041393 published Mar. 8, 1982 (Sumitomo Aluminum Smelting); U.S. Pat. No. 4,126,525 issued Nov. 21, 1978 (Mitsubisihi Keikinzolu Kogyo K.K., Japan) and others.

Introducing alumina into a bath of molten cryolite is known for example as disclosed in EP 440794 published Jan. 27, 1982 (Aluminium Pechiney); French Application 2,483,965 published Dec. 11, 1981 (Aluminium de Grèce S. A. Industrielle et Commerciale, Greece), DE 2914238 of Sep. 4, 1980 (Swiss Aluminium Ltd.) and others. However in all present and patented feeder technologies, the alumina is brought to the cell in one way or another, it is then added or dumped on the top of the electrolyte or electrolyte with a frozen crust on top, and then the alumina is forced into the liquid electrolyte by a mechanical bar which pushes the alumina as well as the crust into the liquid electrolyte. This bar (or hammer or stud) which pushes the alumina into the electrolyte may get covered with a frozen layer of electrolyte. The system used to add or feed alumina to the electrolyte surface, before the alumina is forced into the liquid electrolyte, may occasionally get plugged due to lumps of alumina. This feeding system has to be able to add known amounts of alumina to the surface of the electrolyte and it may be a purely mechanical device or a device using gases. Presently there is technology available to carry out this task in a satisfactory manner. However, not one of these technologies deals with the injection of alumina into the liquid electrolyte with a carrier gas. Because these feeding methods need a mechanical device to push the alumina into the liquid electrolyte, these feeding devices need acces to the liquid electrolyte. In terms of a pre-baked cell, this is not a problem. However, for Soderberg cells, this is only possible around the perimetry of the cell. This leads to problems because the electrolyte in this region may be colder than that directly beneath the anodes, there is less stirring, and that is not the region where the alumina is consumed. There is therefore a need for a method and a device which enable to inject alumina directly where it is needed, where there is sufficient gas stirring and where the heat is generated, namely in the interpolar gap area between the anode and the liquid aluminum cathode.

The use of a gas has also generally been suggested as an auxiliary agent for adding alumina to the bath, for example EP 206,555 published Dec. 30, 1986 (Alcan International Ltd.); CH 645676 published Oct. 15, 1986 (Swiss Aluminium Ltd.), EP 69057 published Jan. 5, 1983, and others.

It will thus appear that the art has not successfully addressed the problem of unplugging an alumina injector which introduces the powder inside the bath.

It is therefore an object of the present invention to provide a method and an apparatus which enables the injection of alumina and other powdered material below the surface of the electrolyte which makes sure that the injector will not become permanently plugged

SUMMARY OF INVENTION

The above and other objects of the present invention may be achieved by providing a method for adding powdered material to a bath of molten electrolyte in an electrolysis cell, the cell including an anode and a cathode to perform electrolysis of the powdered material in the molten electrolyte. The method preferably comprises continuously or semi-continuously feeding the powdered material along with a gas through a duct formed in the anode, the gas being inert with respect to the molten electrolyte and the anode, and injecting the powdered material and gas beneath the surface of the electrolyte.

In accordance with a preferred embodiment, the powdered material comprises alumina and the electrolytic bath comprises molten cryolite with various salt additives such as $AlF_3$, $CaF_2$, $Al_2O_3$, $MgF_2$ and LiF. The gas may be nitrogen, argon, carbon dioxide, mixtures thereof, and the like or an impure nitrogen stream from a membrane $N_2$ generator, such as that described in U.S. Pat. No. 5,318,759, Michael J. Campbell et al, issued Jun. 7, 1994; U.S. Pat. No. 5,320,650, John W. Simmons, issued Jun. 14, 1994; U.S. Pat. No. 5,320,754, Rachel S. Kohn et al., issued Jun. 14, 1994; U.S. Pat. No. 5,320,818, Diwakar Garg et al., issued Jun. 14, 1994; U.S. Pat. No. 5,322,549, Richard A. Hayes, issued Jun. 21, 1994; U.S. Pat. No. 5,322,917, Brian C. Auman et al., issued Jun. 21, 1994; U.S. Pat. No. 5,324,430, Tai-Shung Chung et al., issued Jun. 28, 1994; U.S. Pat. No. 5,332,597, Michael F. Carolan et al.; U.S. Pat. No. 5,328,503, Ravi Kumar et al., issued Jul. 12, 1994; U.S. Pat. No. 5,330,561 Ravi Kumar et al., issued Jul. 19, 1994; and EPO 0 603 798, Ravi Prasad published Jun. 29, 1994. These references all teach membranes that can be used to produce nitrogen, as well as the production of nitrogen using the pressure swing adsorption or vacuum swing adsorption processes. For example, U.S. Pat. No. 5,318,759 teaches the production of high purity nitrogen gas using a membrane or a pressure swing adsorption system. Other patents such as U.S. Pat. No. 5,320,651; U.S. Pat. No. 5,320,754; U.S. Pat. No. 5,322,549; U.S. Pat. No. 5,322,916; U.S. Pat. No. 5,322,917; U.S. Pat. No. 5,324,430; U.S. Pat. No. 5,332,597 and EPO 0 603 798 describe membranes that could be used for the production of nitrogen. Nitrogen can also be obtained in a so called mini cryogenic air separation plant commonly referred to as "APSA". The powdered material is preferably fed on average at the same rate as it is consumed by the electrolysis. The powdered material and gas are preferably fed intermittently at regular intervals through the duct.

In accordance with another embodiment, the method comprises providing a rotor plate formed with regularly distributed pockets, which are individually alignable with the duct upon rotation of the rotor plate, rotating the rotor plate and while it is being rotated, continuously filling the pockets and simultaneously individually aligning them, in turn, opposite the duct, while simultaneously flowing a low pressure inert gas into a pocket located opposite the duct, and intermittently injecting the powdered material and inert gas below the surface of the electrolyte.

In accordance with another embodiment, a high pressure gas is downwardly introduced into the duct to clear blockage that may form therein.

In accordance with another embodiment, there is provided an apparatus for adding powdered material to a bath of molten electrolyte in an electrolysis cell, the bath including an anode and a cathode to perform electrolysis of the powdered material, the anode having a longitudinal duct formed therein. The apparatus comprises means for continuously or semi-continuously feeding the powdered material and a gas which is inert with respect to the molten electrolyte and the anode into the duct, and means for injecting a mixture of the powdered material and inert gas after passage thereof through the duct, below the surface of the molten material.

BRIEF DESCRIPTION OF DRAWINGS

The invention will now be illustrated, but without limitation, by means of the annexed drawings, in which.

DESCRIPTION OF PREFERRED EMBODIMENTS

Figure 1:
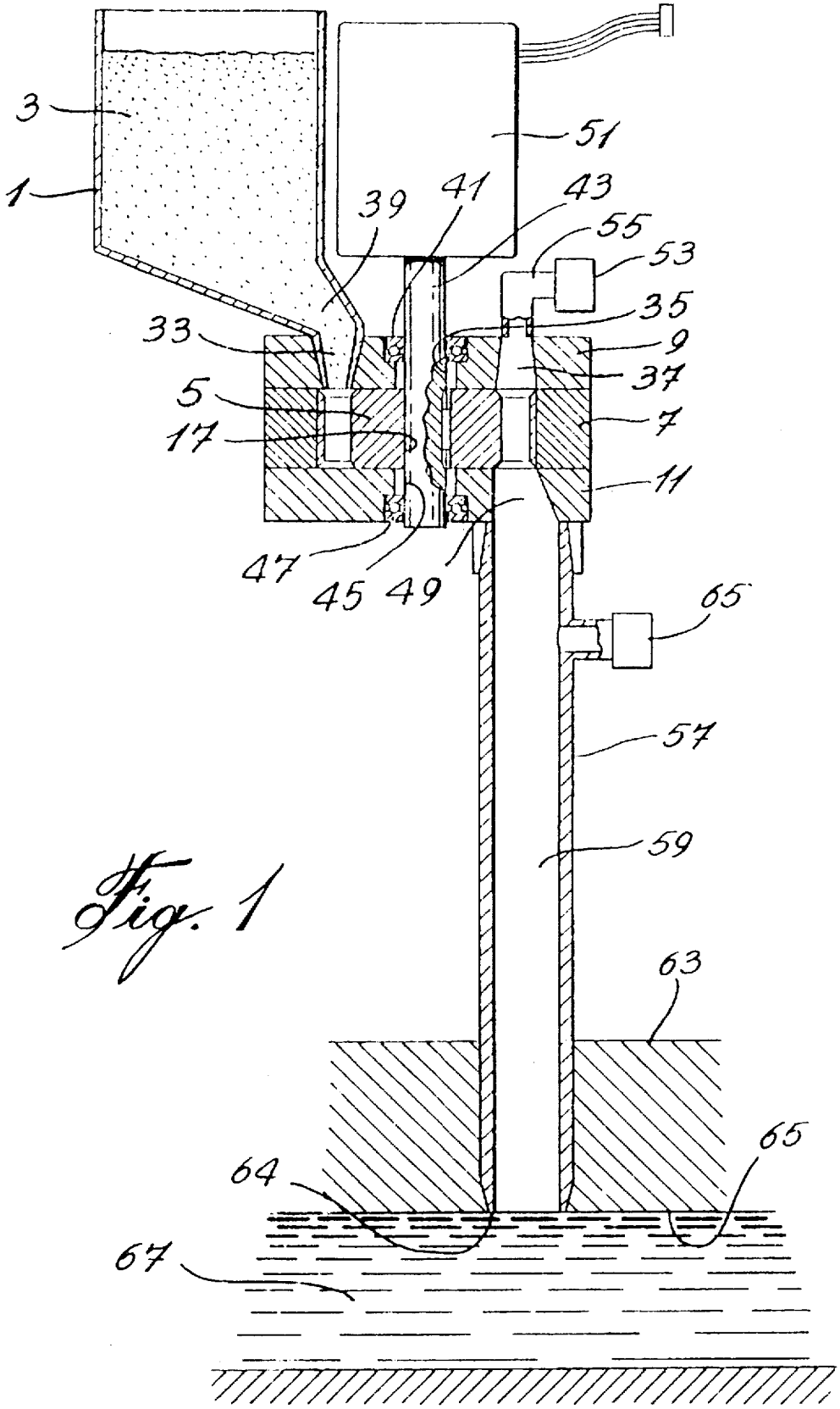
FIG. 1 is a cross-sectional view of an apparatus according to the invention.

The invention described in connection with the drawings is aimed at the injection of aluminum oxide powder into a cryolite-based electrolyte using nitrogen as carrier gas. Obviously the invention is susceptible of much broader application.

Specifically, the apparatus which is illustrated includes a hopper 1 which is adapted to contain a supply of alumina 3. Immediately below hopper 1, there is an alumina and nitrogen feeding device which consists of a rotor plate 5, rotor housing plate 7, upper rotor housing plate 9 and lower rotor housing plate 11.

Figure 2:
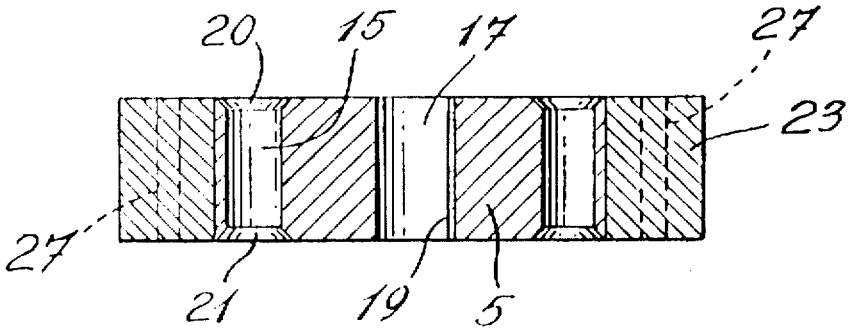
FIG. 2 is a cross-sectional view through the rotor housing plate including the rotor plate.
Figure 3:
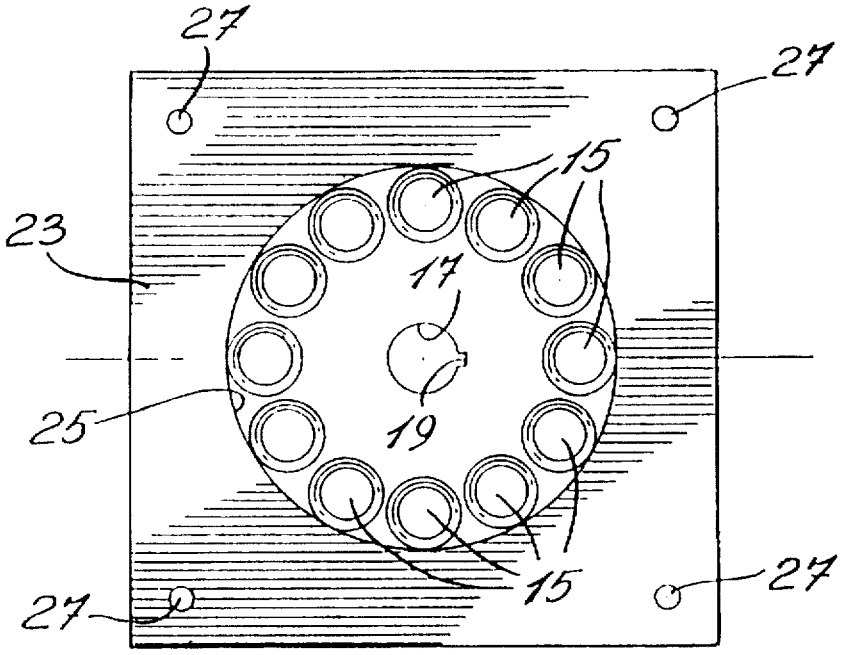
FIG. 3 is a top plan view of the rotor housing plate and rotor plate.

Referring more particularly to FIGS. 2 and 3 it will be seen that rotor plate 5 consists of a disc shaped member 13 having a given thickness which is left entirely to the designer of the apparatus bearing in mind the individual amounts of alumina to be fed to the bath of molten cryolite (not shown). Disc shaped member 13 has a series (twelve in the embodiment illustrated in FIG. 3) of holes 15 bored there through and each designed to house a quantity of alumina. As shown, the holes are preferably regularly distributed along the outer circumferential edge of the disc shaped member 13. In addition, a rotor shaft hole 17 with key way 19 is formed centrally of the disc like member to receive and engage a shaft which will be discussed hereinbelow. Referring now more particularly to FIG. 2, it will be seen that the twelve holes 15 are shaped to define pockets to receive alumina and for this purpose they are each preferably tapered at 20 and 21 at both ends thereof. The tapering portions 20 and 21 are of course intended to facilitate the introduction in and delivery out of alumina from the twelve pockets 15.

Referring again to FIGS. 2 and 3, a square rotor housing plate 23 is illustrated. As shown in FIG. 2, this rotor housing plate 23 has the same thickness as the rotor plate 5 and is formed with a central circular opening 25 which is designed to allow the rotor plate 5 to freely rotate therein by any means known to those skilled in the art. Bolt holes 27 are provided to assemble the various pieces of the rotor assembly.

The rotor assembly, as better illustrated in FIG. 1, in addition to comprising rotor plate 5 and rotor housing plate 23 includes upper and lower rotor housing plates 9 and 11. Upper rotor housing plate 23 is rectangular and is shaped to fit exactly over rotor housing plate 23. It is formed with an inverted truncated opening 33, a central shaft opening 35 and a truncated opening 37. Before further discussing the construction of the upper rotor housing plate 29, it must be emphasized that hopper 1 comprises a hopper inlet 39 which is disposed exactly above inverted truncated opening 33 so as to permit passage of alumina 3 into opening 33. It will also be noted that a bearing device 41 is placed inside central shaft opening 35 to permit free rotation therein of a shaft 43 to be described more in detail later.

With reference once again to FIG. 1, it will be noted that lower rotor housing plate 11 is also preferably rectangular as is upper rotor housing plate 9. It is placed against the underface of rotor plate 5. Lower rotor housing 11 has a central shaft opening 45 in which is disposed another bearing device 11, to permit free rotation therein of shaft 43. A truncated opening 49 is formed therethrough to be in alignment with truncated opening 37 and one pocket 15 upon proper rotation of rotor plate 5.

A servo drive motor 51 is preferably disposed above the rotor plate assembly, which is operatively connected to shaft 43. As illustrated, this shaft 43 extends all through the rotor assembly to be freely rotatable with respect to upper and lower rotor housing plates 9 and 11 as previously discussed. However, the shaft is operatively connected in known manner with rotor plate 5 to rotate the latter upon operation of motor 51.

The apparatus which is illustrated also includes a nitrogen supply (not shown) which leads into a low pressure nitrogen inlet pipe 53 which is connected by means of a piping system 55 to opening 37 and upon proper rotation of rotor plate 5, to pocket 15 and opening 49.

The apparatus also includes a black iron injection lance 57 which is formed with a central duct 59 and which extends through anode 63 down to the lower suface 65 of the anode which is immersed into the electrolyte 67. Thus the lance is long enough to extend down to the bottom surface of the anode where the tip 64 of the lance is consumed at the same rate as the anode itself. Finally, a high pressure burst inlet pipe 65 is connected to the top end of black iron injection lance, and also to a source of high pressure nitrogen not shown. This inlet pipe is used for clearing any blockages that may form at the lower end of lance 57.

The principle of operation of the device is as follows. Nitrogen gas or other suitable inert gas flows through the low pressure side of the system at a suitable flow rate. The gas feed is supplied at a suitable pressure. As the gas flows through the powder metering device (rotor plate), powder is entrained in the gas. The powder/gas mixture enters the injection tube (duct 59 in lance 57) and is forced into the electrolyte. The anode gases and the gas bubbles created during injection provide sting in the electrolyte and create a dispersion of the alumina in the electrolyte.

Periodically, the injection tube may become clogged. When this occurs, a high pressure gas burst is provided via a solenoid valve (not shown) and separate high pressure burst inlet pipe 65. This burst clears the clog from the tube. The high pressure burst may be supplied by the same or different inert gases as the low pressure gas.

Several advantages are realized by injecting alumina into the electrolyte. First, the alumina is evenly dispersed when it enters the electrolyte. Second, the carrier gas provides siring to mix the alumina in the electrolyte. Third, crust breaking is eliminated which reduces the emissions from the cells. Fourth, the alumina can be fed nearly continuously to the electrolyte. Finally, because of the controlled feeding, process control can be applied thus avoiding anode effects.

We claim:

1. Method for adding powdered material to a bath of molten electrolyte in an electrolysis cell, said cell including an anode and a cathode to perform electrolysis of said powdered material in molten electrolyte, said method comprising feeding said powdered material along with a gas through a duct formed in said anode, said gas being substantially inert with respect to said molten material and said anode, and injecting said powdered material and said gas beneath the surface of said electrolyte.

2. Method according to claim 1, wherein said powdered material comprises alumina and said electrolytic bath comprises cryolite.

3. Method according to claim 1, wherein said inert gas is selected from the group consisting of nitrogen, argon, carbon dioxide and mixtures thereof.

4. Method according to claim 3, wherein the inert gas comprises nitrogen stream derived from a membrane $N_2$ generator.

5. Method according to claim 3, wherein the inert gas comprises nitrogen which has been obtained by a pressure swing adsorption process.

6. Method according to claim 3, wherein the inert gas comprises nitrogen which has been obtained by a vacuum swing adsorption.

7. Method according to claim 3, wherein the inert gas comprises nitrogen which has been obtained from a mini cryogenic air separation plant.

8. Method according to claim 1, which comprises feeding said powdered material on averageat the same rate as it is consumed by the electrolysis.

9. Method according to claim 1, which comprises intermittently feeding said powdered material and said gas at regular intervals through said duct.

10. Apparatus for adding powdered material to an electrolytic bath of molten material, said bath including an anode and a cathode to perform electrolysis of said molten material, wherein said anode has a longitudinal duct formed therein, said apparatus comprising means for continuously feeding said powdered material and a gas which is inert with respect to said molten material and said anode into said duct, and means for injecting a mixture of said powdered material and said inert gas after passage thereof through said duct, below the surface of said molten material.

11. Apparatus according to claim 10, which comprises first storage means to hold a supply of said powdered material, and second storage means to hold a quantity of inert gas under low pressure, and means for continuously delivering said powdered material and said inert gas to said continuous feeding means.

12. Apparatus according to claim 11, wherein said supply of powdered material comprises alumina and said inert gas is selected from the group consisting of nitrogen, argon and carbon dioxide.

13. Apparatus according to claim 10, wherein said molten material comprises cryolite.

14. Apparatus according to claim 10, which comprises control mans effective to feed said powdered material at the same rate as it is consumed by the electrolysis.

15. Apparatus according to claim 10, which comprises means operative for intermittently feeding said powdered material and said gas at regular intervals through said duct.

16. Apparatus according to claim 10, which comprises a hopper to contain powdered alumina, said hopper connected to said continuous feeding means for delivering said powdered alumina thereto, and a low pressure nitrogen inlet pipe connected at the upstream end to a source of nitrogen under low pressure and at the downstream end to said continuous feeding means.

17. A method for adding powdered material to a bath of molten electrolyte in an electrolysis cell, said cell including an anode and a cathode to perform electrolysis of said powdered material in molten electrolyte, said method comprising intermittently feeding said powdered material and a gas through a duct formed in said anode, said gas being substantially inert with respect to said molten material and said anode, and injecting said powdered material and said gas beneath the surface of said electrolyte, while providing a rotor plate formed with regularly distributed pockets, said pockets being individually alignable with said duct upon rotation of said rotor plate, rotating said rotor plate and while said rotor plate is being rotated, continuously filling said pockets and simultaneously individually aligning said pockets, in turn, opposite said duct, and simultaneously flowing low pressure inert gas into a pocket located opposite said duct.

18. The method according to claim 17, which comprises introducing a high pressure inert gas downwardly into said duct to clear blockage that may form in said duct.

19. The method of claim 17, wherein said powdered material comprises alumina.

20. The method of claim 17, wherein said electrolyte bath comprises cryolite.

21. The method of claim 17, wherein said inert gas is selected from the group consisting of nitrogen, argon, carbon dioxide and mixtures thereof.

22. An apparatus for adding powdered material to an electrolytic bath of molten material, said bath including an anode and a cathode to perform electrolysis of said molten material, wherein said anode has a longitudinal duct formed therein, said apparatus comprising means for continuously feeding said powdered material and a gas which is inert with respect to said molten material and said anode into said duct, and means for injecting a mixture of said powdered material and said inert gas after passage through said duct, below the surface of said molten material, said apparatus further comprising a hopper to contain powdered alumina, said hopper being connected to said continuous feeding means for delivering said powdered alumina thereto, and a low pressure nitrogen inlet pipe connected at the upstream end to a source of nitrogen under low pressure and at the downstream end to said continuous feeding means;

with the continuous feeding means comprising a rotor plate formed with regularly distributed pockets, and a motor connected to said rotor plate through a rotor shaft to operate said rotor plate, said pockets being distributed at regular intervals along a circumferential edge of said rotor plate, said pockets being individually alignable with said duct and opening thereinto upon rotation of said rotor plate, said inlet pipe being in communication with one said pockets when said pocket is aligned with said duct.

23. The apparatus according to claim 22, which comprises fixed upper and lower rotor housing plates, said rotor plate being rotatably mounted between said fixed upper and lower rotor housing plates, said upper fixed rotor housing plate having first and second openings extending therethrough, said first opening aligned with an outlet provided in said hopper to deliver a quantity of powdered alumina into one said pockets, said second opening being connected with said inlet pipe to deliver said low pressure nitrogen into one said pockets for mixing with said powdered alumina which is thereafter allowed to be introduced into said duct, said lower fixed housing plate, having a third opening extending therethrough and in communication with said duct through a pipe feeder coupling, said third opening adapted to receive a mixture of powdered alumina and low pressure nitrogen formed in one said pockets and deliver said mixture to said duct.

24. The apparatus according to claim 23, which comprises an injection lance which extends from said lower rotor housing plate down to the lower surface of the anode which is immersed into the electrolyte, so that said lance is consumed at the same rate as the anode.

25. The apparatus according to claim 24, wherein said rotor plate is shaped as a disc, having a rotor shaft hole to fixedly receive an end of said shaft, said pockets being circumferentially distributed along the outer edge of said disc, a rotor housing plate having a central circular opening, and means for rotatably mounting said disc in said circular opening.

* * * * *

UNITED STATES PATENT AND TRADEMARK OFFICE

CERTIFICATE OF CORRECTION

PATENT NO. : 5,759,382

DATED : Jun. 2, 1998

INVENTOR(S) : Utigard et al.

It is certified that error appears in the above-identified patent and that said Letters Patent is hereby corrected as shown below:

In Claim 14, line 45, please delete the word "mans", and insert therefor the word --means--.

Signed and Sealed this

Twenty-second Day of September, 1998

*Attest:*

Bruce Lehman

BRUCE LEHMAN

*Attesting Officer*

*Commissioner of Patents and Trademarks*